US011351435B1

(12) United States Patent
Efremov

(10) Patent No.: US 11,351,435 B1
(45) Date of Patent: Jun. 7, 2022

(54) GOLF CLUB ATTACHMENT

(71) Applicant: Viktor Efremov, Raleigh, NC (US)

(72) Inventor: Viktor Efremov, Raleigh, NC (US)

( * ) Notice: Subject to any disclaimer, the term of this patent is extended or adjusted under 35 U.S.C. 154(b) by 263 days.

(21) Appl. No.: 16/015,399

(22) Filed: Jun. 22, 2018

(51) Int. Cl.
*A63B 69/36* (2006.01)
*A63B 102/32* (2015.01)

(52) U.S. Cl.
CPC ..... *A63B 69/3608* (2013.01); *A63B 69/3632* (2013.01); *A63B 2102/32* (2015.10)

(58) Field of Classification Search
CPC ..... A63B 69/3608; A63B 69/3632; A63B 69/3685; A63B 2102/32
See application file for complete search history.

(56) References Cited

U.S. PATENT DOCUMENTS 2,094,417 A * 9/1937 Strohbach ..... A63B 53/14 473/206
2,234,638 A * 3/1941 Topping ..... A63B 69/3632 473/206
3,554,554 A * 1/1971 Zane ..... A63B 53/14 473/206
6,994,633 B2 * 2/2006 Czaja ..... A63B 69/0059 473/219
7,326,134 B2 * 2/2008 Collucci ..... A63B 49/08 473/553
9,017,182 B1 * 4/2015 Freiler, Jr ..... A63B 69/3608 473/205
9,320,959 B1 * 4/2016 Awad ..... A63B 69/3685
2009/0156322 A1 * 6/2009 Luly ..... A63B 69/3632 473/206

* cited by examiner

*Primary Examiner* — Ryan A Reis
(74) *Attorney, Agent, or Firm* — Olive Law Group, PLLC

(57) ABSTRACT

A method and device for improving golf ball drive speed and accuracy and decreasing wrist tension in the performance of swinging a golf club, by decreasing the burden of grip force to afford retention of the grip of a golf club during the swing, and by subsequently reducing detrimental and compounding effects resulting from other, prior methods in the art that are used to control swing motion.

13 Claims, 5 Drawing Sheets

GOLF CLUB ATTACHMENT

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD

At least some embodiments disclosed herein relate, in general, to the field of golf equipment and more specifically group-enhancing methods and devices.

BACKGROUND

Performance of a powerful, controlled, and repeatable swing of a golf club is of paramount importance to success in minimizing stroke count in a game of golf. However, this task frustrates most golfers, and particularly during the stage of a swing known as the downswing. Most, if not all, amateur golfers have one problem in common during the downswing: an early "release" of the club.

A golf club swing begins with the backswing. It begins with rotating the club up and rearward (relative to the intended direction to strike the golf ball), and ends when the golfer has reached the end of his arms' and hands' range of motion. At this point, the golf club head deflects the shaft of the golf club, until it comes to a halt. The downswing begins upon the club head reversing its motion, the golfer then turning his body toward the intended direction of ball travel, and swinging his arms down, loading the shaft of the club against the inertia of the head of the club.

Consider the case of a right-handed golfer, and consider his left arm his leading arm, and his right arm as a trailing arm. At the beginning of the downswing, the golfer's trailing arm is bent significantly, while the leading arm is only slightly bent, with respect to each arm's respective elbow. As the downswing progresses, the golfer straightens the leading arm, but restrains the trailing arm against outward movement, until reaching a point in the downswing when striking the ball with greater club-head velocity will only be achieved by adding tangential velocity using the golfer's joints, sequentially extending from the torso to his hands, until club head strikes the golf ball.

The point in the downswing at which the golfer sets-in-motion the additional successive-joints' movements is known as the "release." Release may be defined according to a change in "lag angle." "Lag angle" is the angle between the leading arm and the shaft of the club during the downswing. In an ideal downswing, the lag angle starts acute, and then gets more acute during the initial part of the downswing, as the golfer turns his torso toward the ball, and brings his elbows down. This is known as "loading" the golf club with power.

When the golfer's trailing arm has nearly reached his torso, the golfer's straightened leading arm forces the wrist of the trailing arm to descend and extend it away from his body. It is at this point that the club rotates about the instant center of the golfer's hands. As the club angularly articulates, the club head moves outward, and away from the leading arm, increasing the lag angle. Release is therefore an event that occurs at the moment that the lag angle begins to increase.

Maximum tangential velocity is achieved by the release effecting the maximum acceleration of the club about the instant center of the golfer's hands. Given a particular range of angular motion (about the golfer's wrists), from release to strike, the greatest change in velocity occurs by the period between release and strike being as small as possible. Because the strike ends the downswing, this requires the release to begin late in the swing. When release begins early, the club progresses through the same angular sweep over a longer period of time, and the acceleration through the sweep is gentler. With lower acceleration, the force of striking the ball is lower, and drives are shorter.

An "early" release refers to a swing in which the golfer began to straighten his trailing arm at a point in the swing that was above the ideal release point. It can also refer to a swing in which lag angle is greater than ideal at the typical location in the swing at which lag angle should begin to increase (such as when the golfer's trailing arm has nearly reached his torso).

An ideal grip tightness permits the golfer's fingers to deflect, more at the pinky finger and less at the index finger, to let the handle articulate within the palm. The handle, or grip, end of the club thereby enters the swing while the club head descends but refrains from extending out and away from the golfer's torso. This dissimilar angular progression causes the club to momentarily "lag" behind the movement of the golfer's arms, and is the cause of the lag angle to decrease during the initial part of the downswing. An excessively tight grip more rigidly locates the grip-end of the shaft within the palm, limiting the ability of the swing to lag behind the arms. Even if there is otherwise no other error in the motion of the downswing, this is still an "early release," because the lag angle began to increase from a point that was far too early.

There are many reasons for why a golfer might have an early release in his swing, due to an excessively tight grip. Here is an example:

A golfer may attempt to cure a drive which diverges from the intended direction of travel by squeezing the golf club grip more tightly. It may seem logical, because if a golfer is under the impression that his swing is otherwise correct, then he might conclude that the divergent trajectory of the ball resulted from allowing the club to twist within his hands. It is not unreasonable to presume that a tighter grip might prevent slip.

Whether the tighter grip straightens the drive or not, though, the tightness limits the ability of the fingers to allow the club to articulate within the palm, which limits the ability of the downswing to lag the club behind the rate of the arms' motion. The limitation on lag prevents the swing from "loading" the golf club with power, and the limited ability to decrease lag angle during the downswing shortens the amount of the downswing that can progress before lag angle begins to increase, inducing the "early release" which softens the ability of the club to provide maximum power over the course of the release, and which ultimately shortens drive distance.

In addition to an excessively tight grip preventing the club to lag behind the arms, the force of the grip can also fight the motion of the golf club, about the hands, during the period from release to the strike. Exerting a very tight grip requires a significant amount of tension between the forearm and the fingers, translated through the wrist. This tension force thereby locks the hands to a limited range of travel about the wrist, relative to the forearm.

Essentially, this means that (in an ideal downswing), the extension of the trailing arm (following release) renders the wrist of the leading arm into a fulcrum, such that the trailing arm's motion (the wrist, outward from the torso, after the elbow approaches the torso) provides a tangential push, until the trailing arm's wrist reaches the outward distance from the torso which is roughly equal to the leading arm's distance from the torso.

This linkage-like motion requires that the hand on the trailing arm maintain a grip on a bar which is pivoting about an offset point, and therefore requires the trailing arm's wrist to be able to freely move. Tightness applied to increase grip imposes a resistance to either wrist pivoting freely, which counters the necessary linkage-like motion of the club about the wrist of the leading arm. Therefore, the tension of a tighter grip may also infiltrate the ability of the release contributing the maximum amount of force to increase club head velocity.

In view of the above, there is a long felt need in the art for a solution which deters gripping a club excessively tightly, and a long felt need in the art to reduce wrist tension while maintaining the security of grip in a golfer's hands, that preempts or deters early club release, fosters an ideal lag angle, increases club head speeds and ball-drive distances.

SUMMARY

The present invention includes embodiments of devices and methods which reduce or completely eliminate the wrist tension in a golf swing, to cure early club release, foster a proper lag angle, and increase club-head speed and ball drive distance.

An exemplary embodiment of the present invention is an attachment which may be fastened to the shaft of a golf club. It is contemplated that a wide variety of fastening methods are adequate, so long as the attachment provides a fixation point on the shaft which resists translation along the length of the shaft during a golf club downswing. This attachment which provides a point of resistance to axial motion along the club shaft thereby is adapted to serve as a fixation point for features that are adapted to receive the hand or hands of a golfer. Such features are thereby adapted to enhance the ability of the golfer's hands to control a golf club with a lighter grip force. This means that a golfer can thereby execute the downswing of a club without incurring the many detriments of an excessively tight grip. It is also contemplated that preferred embodiments attach in a way that controls against rotation of the attachment about the shaft, so that twisting motion (of the club, within a golfer's closed hands and fingers) is also limited.

An exemplary embodiment of the invention provides a circumferential cuff. Such a cuff may be of a type which is predominantly C-shaped, with an internal radius that is larger than the radius of the shaft of a golf club, at least at a position along the shaft which is offset some small distance from the golf club grip. The cuff can then be translated along the shaft, in a direction that approaches the grip. The cuff can then be secured to any number of locations on the club, including positions on the shaft that are immediately proximate the golf club grip and at positions on the grip itself.

An exemplary embodiment is one in which the cuff comes into fit with the desired attachment location by being brought toward the grip along the length of the shaft, until the interior of the cuff comes into contact with the circumference of the club (shaft or grip or otherwise) and fits securely enough (or causes enough compression/force between the cuff and the club/shaft/grip) that it provides a fixation point on the club which resists any further axial motion, and preferably also resists rotation about the shaft (about the lengthwise axis of the shaft). However, there is no strict limitation that the invention be secured solely by being translated into attachment about the circumference of the shaft.

Another exemplary embodiment contemplates cuff-tightening methods and mechanisms. Such mechanisms include an alternately positionable tension element to reach through a distance spanning an angular sweep about the circumference of the cuff, to engage a catch and allow articulation of the tension element to decrease the radius and circumference of the cuff. In the case of a C-shaped cuff, such a mechanism would allow for a gap in the cuff to be significantly wider (when open) than the diameter/width of the shaft/club/grip at a desired engagement location, while still being able to ensure a secure engagement with that location (when closed).

One example is a pliant C-shaped cuff, with a catch on one side of its gap, and a pivoting lever on the opposite side of the gap, with a pivoting bar or wire pivotally mounted to the lever. The bar/wire can then be pivoted across the gap, and then engages the catch. Then, pivoting the lever toward the cuff translates the lever-side of the bar/wire away from the gap, pulling the catch toward the lever, to decrease the gap, and therefore the decreases the radius and circumference of the cuff.

However fixation is managed, a golfer's grip is then able to take advantage of the attachment's security on the club by any mechanism or element that limits the ability of the attachment to translate away from a golfer's hand. An exemplary embodiment of such an element is a simple strap or looped strap of a textile cloth or other pliant material that is able to withstand the centrifugal force of a golf club swing. Such a strap, attached to the attachment, allows a golfer to simply insert fingers into the strap, and grip the golf club grip normally.

With at least one finger inserted into the strap, a golf club can be swung without risk of losing grip, with only a minimal amount of grip force. The golfer need only provide as much grip as is necessary to keep the strap from slipping off of his fingers, rather than provide the normal force necessary to leverage the friction coefficient of the grip material into a sliding-friction force sufficient to keep the club from sliding or twisting within his closed fingers. The decreased grip force allows the golfer's hands to move with much less restriction about their respective wrists, and avoid all of the detriments discussed in the Background of the Invention.

The loop or other strap does not necessarily have to be any particular length, nor does it have to be limited or fixed in length. The invention contemplates any mode of providing a strap such that it can achieve the purpose of limiting the movement of the club away from a desired location of hand engagement with the grip of a club, and allow performance of a golf swing without the golfer losing the security of retainment of his grip on the desired golf club grip location. It can be adjustable, with a free end for any material that is in excess of the necessary amount of strap material for the loop, or it can be adjustable by use of hook and loop fasteners or buttons or clips or any other strap-size adjusting mechanism known to a person having ordinary skill now or at any time into the future.

BRIEF DESCRIPTION OF THE DRAWINGS

The embodiments are illustrated by way of example and not limitation in the figures of the accompanying drawings in which like references indicate similar elements.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
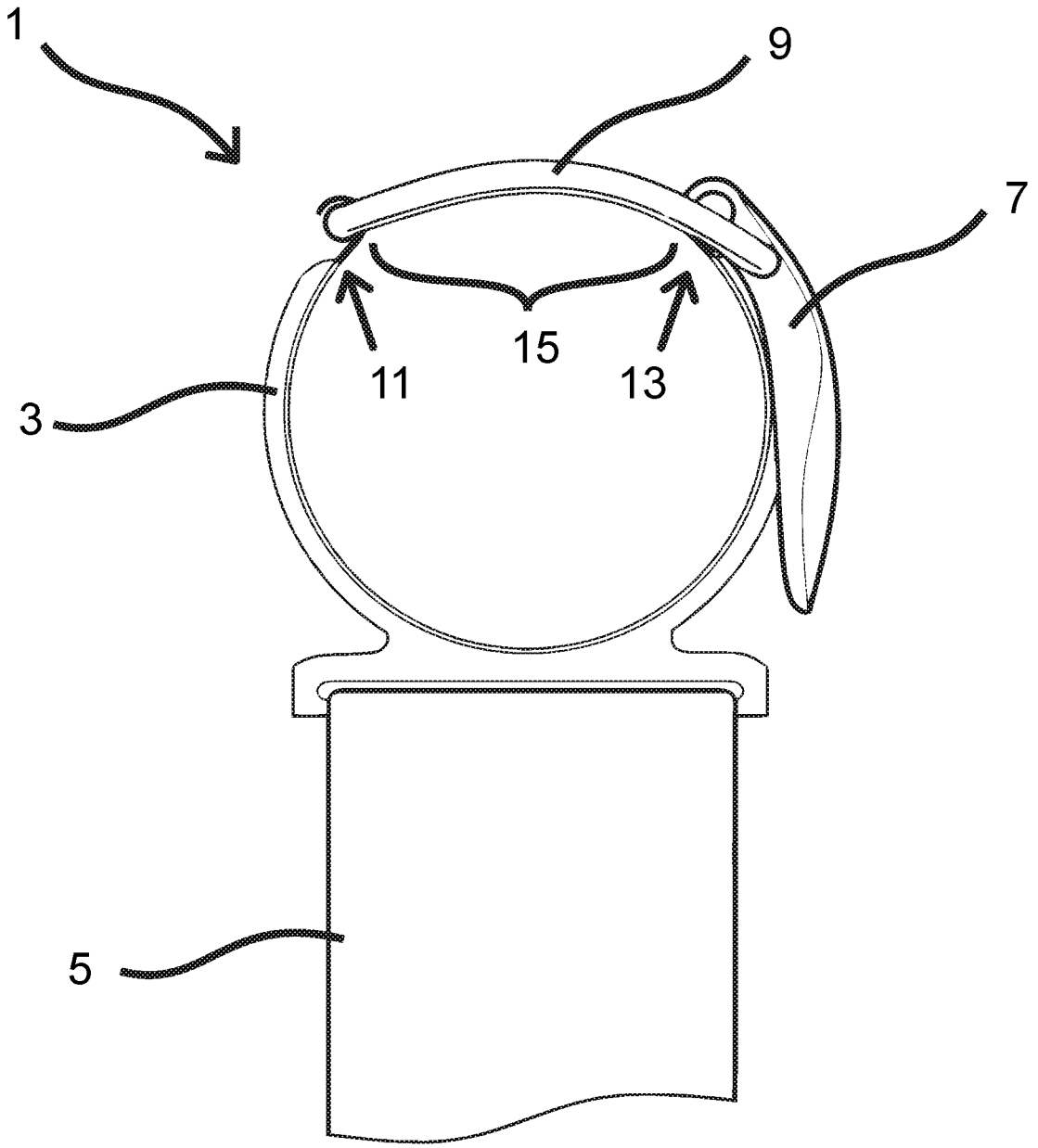
FIG. 1 shows an elevation view of a golf club attachment.

Referring now to FIG. 1, what is shown is a golf club attachment (1) in side elevation. It comprises a cuff (3) and a finger-strap (5). This particular cuff (3) is one which is predominately C shaped, having a gap (15) in its circumference, defined by a catch-side (11) (being one which is shaped into a catch) and a lever-side (13), which comprises a tension-lever (7). The lever (7) is pinned to the lever-side (13) of the gap (15). A lock wire (9) is pinned to the lever (7) and is adapted to being alternately pivotable across the gap (15) and pivotable away from the gap (15), so as to completely open the gap (15). The lock wire (9) is adapted to be received by the catch-side (11). Pivoting the lock wire (9) across the gap (15), and then pivoting the lever (7) toward the cuff (3) thereby brings the lock wire (9) into contact with the catch side (11), and then pulls the catch side (11) towards the lever-side (13). Thereby, completely pivoting the lever (7) towards the cuff (3) decreases the circumference of the cuff (3), and thereby also decreases the radius of the cuff (3).

The strap (5) is attached to the exterior of the cuff (3), securely located against angular deflection (meaning angular offset in the plane within which the strap (5) connects to the cuff (3), about the centerline axis of the circumferential geometry of the cuff (3)). This mounting location ensures that the strap (3) is controlled against angular movement relative to an object about which the cuff (3) has been tightened and angularly-secured-thereto.

Figure 2:
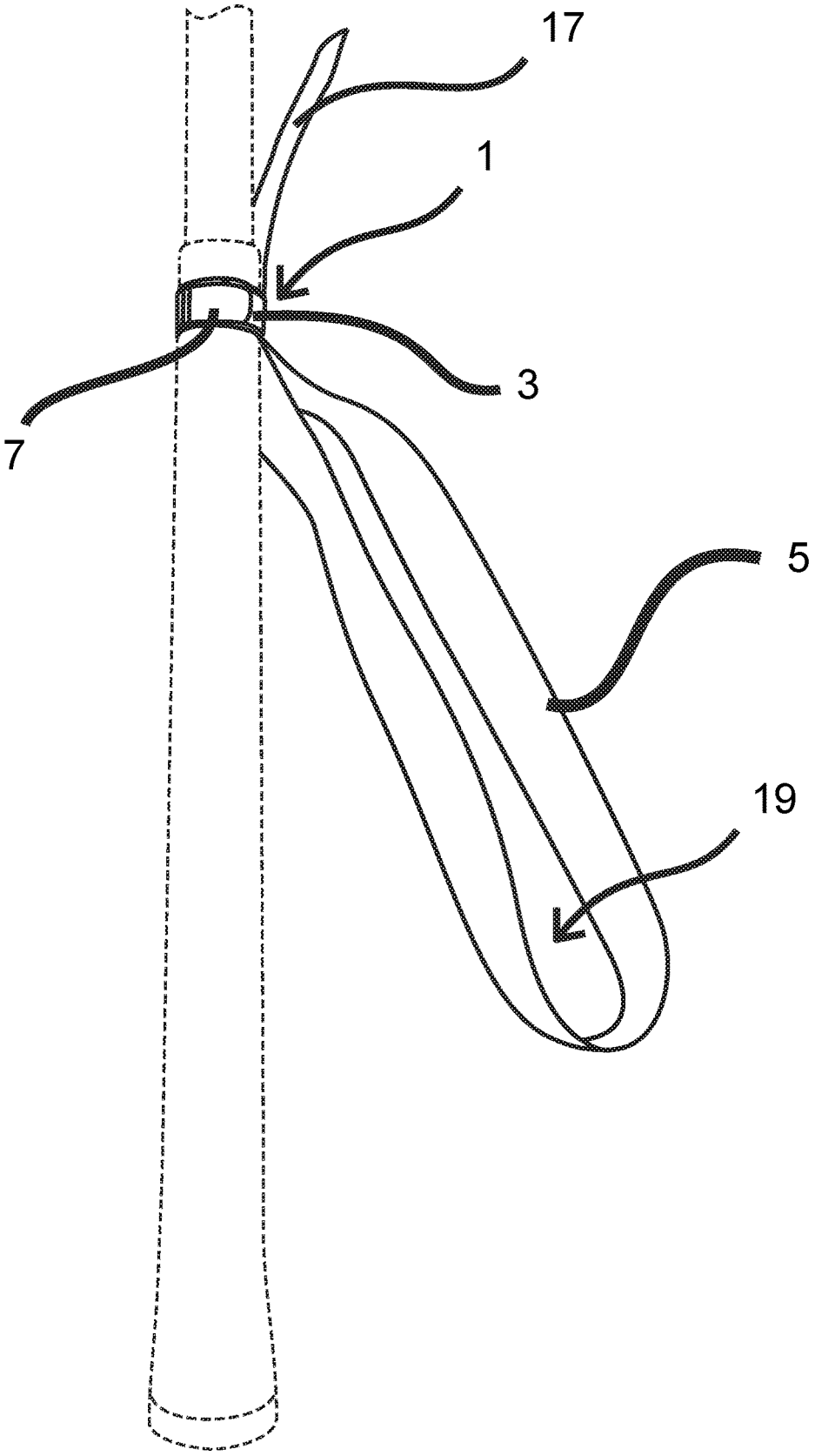
FIG. 2 shows a side perspective view of a golf club attachment, as attached to a golf club.

Referring now to FIG. 2, what is shown is a side perspective view of an exemplary club attachment (1) as attached to a golf club, the club having a shaft and a grip, in the ordinary places and shapes which a person having ordinary skill would understand.

Here, the cuff (3) and the lever (7) are visible, encircling the shaft of the club. Specifically, the cuff (3) is actually in contact with the grip of the golf club, but the cuff (3) is also adapted to engage any other part of the shaft. The strap (5) extends outward away from the cuff (3), and loopingly extends toward the end of the grip, and then back toward the cuff (3), forming a finger-loop area ("loop" (19)) of fabric. The strap (5) may also be executed in any material which has analogous material properties to fabric, such as leather, or sufficiently pliant plastic or rubber with adequate strength for retaining a golf club swing to a hand swinging the club as forcefully as a typical golf swing.

The length which the strap (5) extends from the cuff (3), alongside the grip of the club, towards the end of the club, is sufficiently long that it provides a loop (19) which is large enough to receive the fingers of a hand at a desired position at any point on the grip.

The loop (19) may also be sized in order to provide tensile grip for a hand position at any location along the length of the grip between the location at which the attachment (1) is affixed and the end of the grip/end of the golf club, simply by adjusting the length of the strap (5). A free end (17) of the strap (5) is shown, to show that this is one type of adjustable and re-adjustable embodiment of a strap (5) that can easily allow resizing the loop (19), simply by pulling (or releasing) the free end (17), to vary how much of the strap (5) is excluded from the amount of the strap (5) that participates in defining the size of the loop (19).

Figure 3:
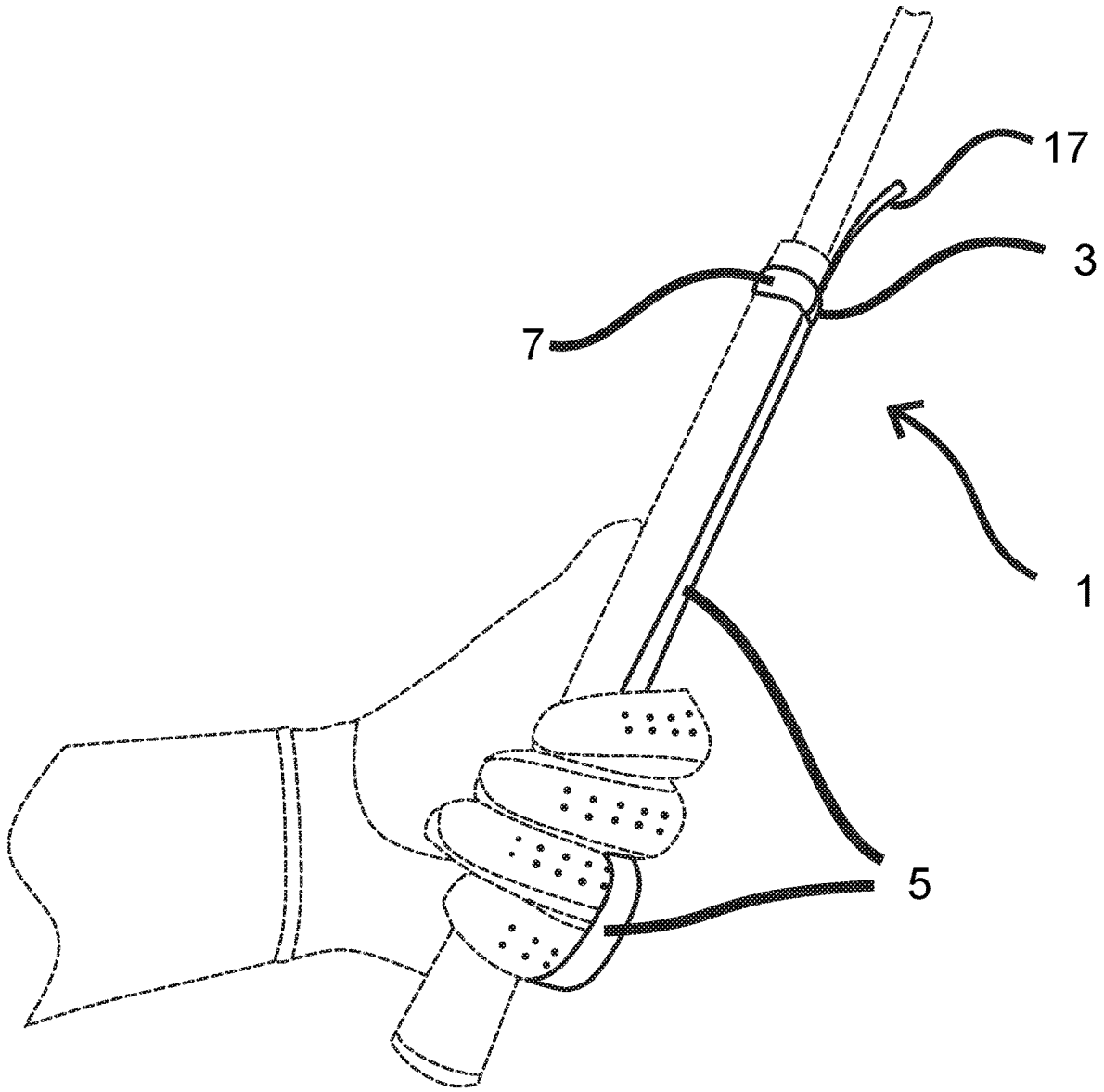
FIG. 3 shows a side elevation view of a golfer hand gripping a golf club grip, and a golf club attachment attached to the golf club.

Referring now to FIG. 3, showing a side elevation view of a golfer's hand, gripping a golf club grip, shows one embodiment of how fingers may be received within the loop (19, FIG. 2) of the strap (5). As described of the embodiment shown in FIG. 2, the strap (5) has been adjusted to a desired length, such that fingers are retained within the strap (5) and the strap (5) is sized such that the strap (5) engages the fingers at a desired position along the length of the grip.

Here, it can be seen that, because the attachment (1) is secured against axial slip along the length of the shaft of the club, and the free end (17) has been pulled to a length at which the strap (5) retains the fingers of the golfer's hand (at a desired location on the grip) such that the strap (5) is pulled taut, the golfer's hand is held against sliding away from the attachment (1), independently of the force that the golfer's hand applies to the grip. With the strap (5) at this length, and the fingers retained through the loop (19, FIGS. 2, 5), while the golfer grips the golf club at this location, the club cannot slip axially relative to the golfers hand. Because the motion of a golf swing will only increase the tension between the attachment (1) and the golfer's fingers, the golfer's retention of the club during a swing is ensured (with repeatable certainty), completely independently of the amount of grip force which the golfer applies to the grip, at any point during the swing.

Figure 4:
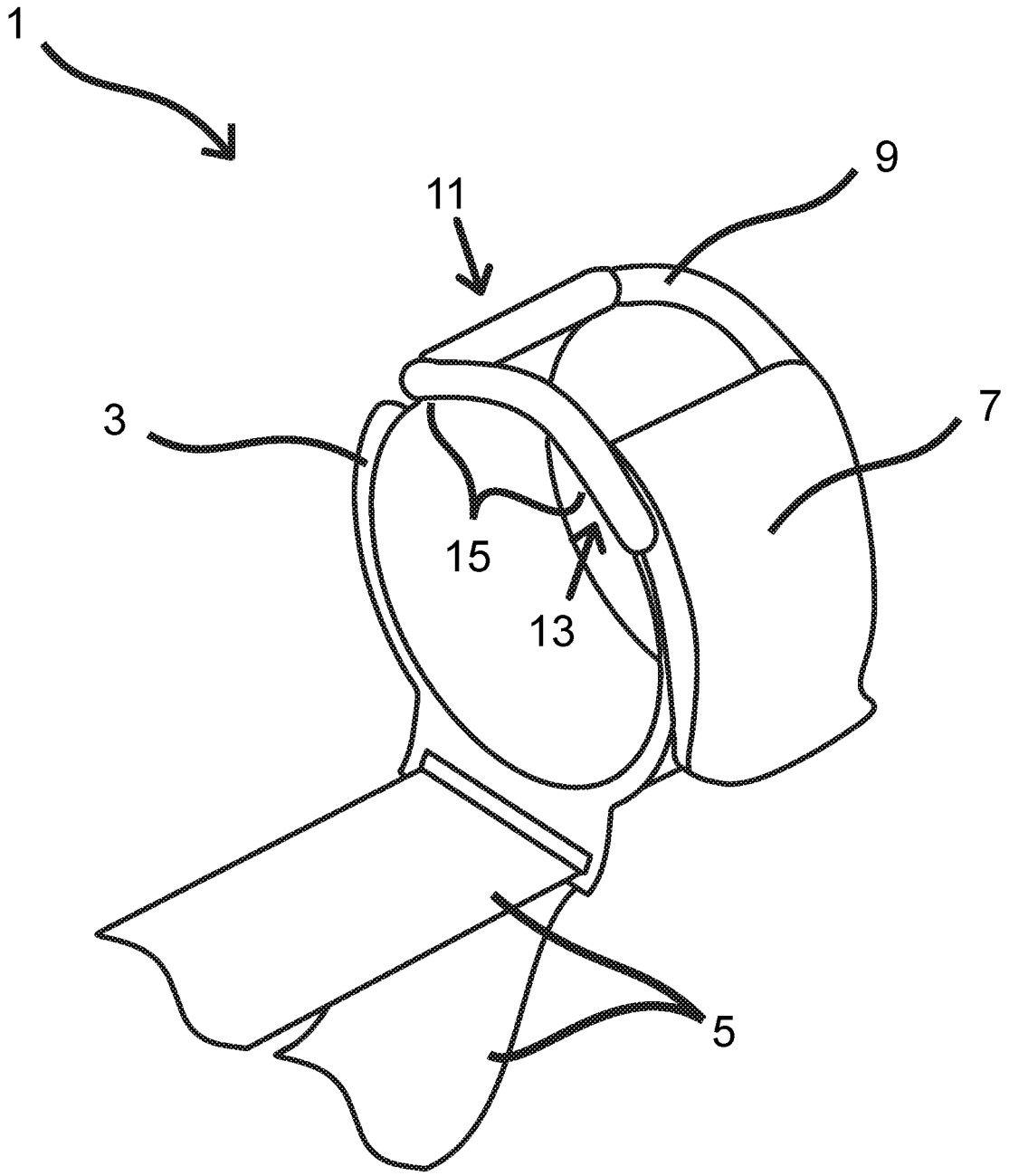
FIG. 4 shows a perspective view of a golf club attachment.

Referring now to FIG. 4, what is shown is a perspective view of an exemplary golf club attachment (1) that is similar to that of FIG. 1, including cuff (3), strap (5), lever (7), catch-side (11), lever-side (13), lock wire (9), and gap (15). FIG. 4 does not show any particular limiting element with respect to a free end (17, FIGS. 2, 3, 5) of the strap (5).

Figure 5:
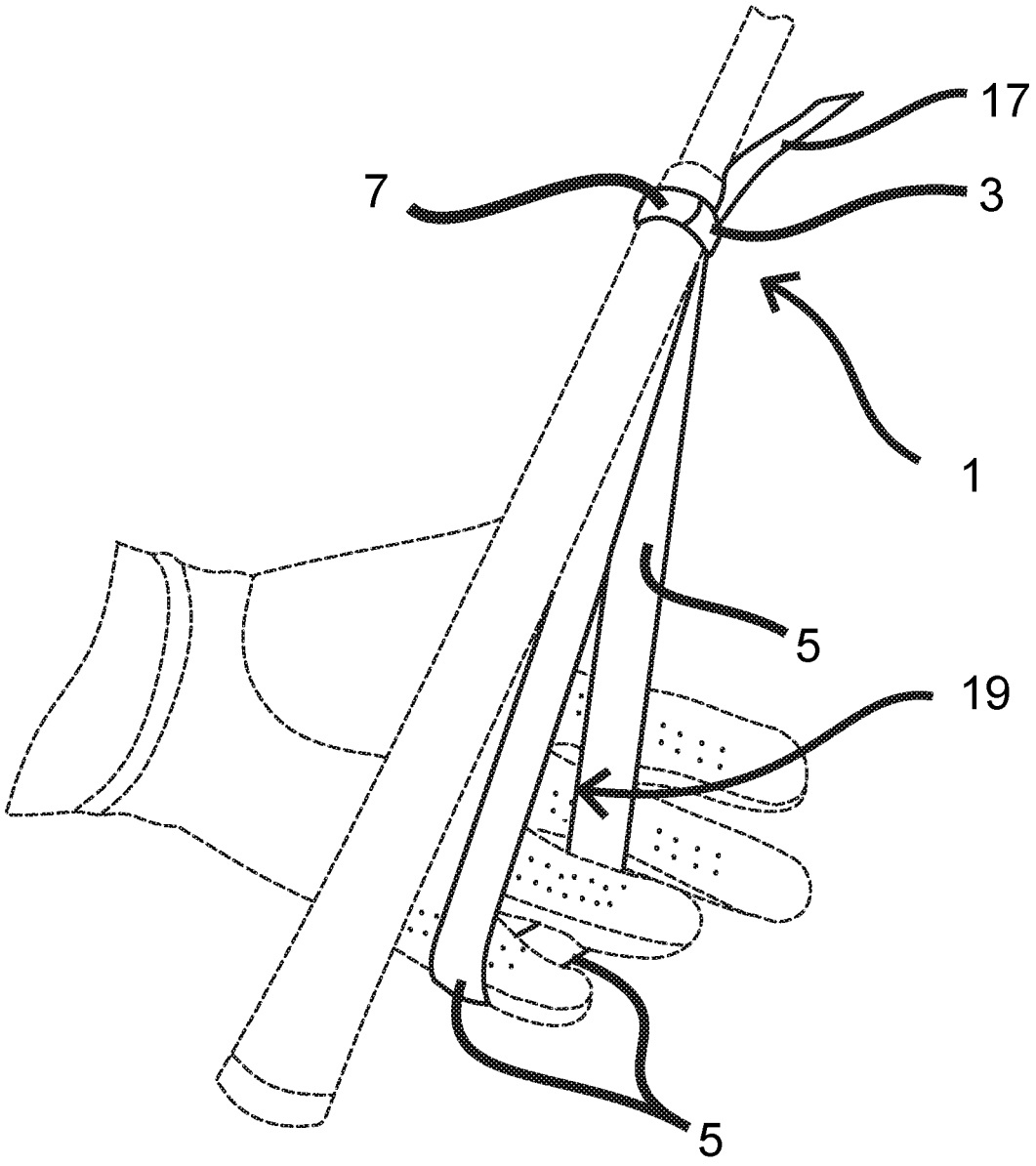
FIG. 5 shows a side elevation view of a golfer hand proximate to a golf club grip, and a golf club attachment attached to the golf club, with golfer fingers inserted into a strap of a golf club attachment.

Referring now to FIG. 5, a side elevation view of a golfer's hand proximate to the grip of a golf club, shows one embodiment of how fingers may be received within the loop (19, also see FIG. 2) of the strap (5). This is essentially the step before FIG. 3, where the golfer's hand is closed around the grip. As described of the embodiment shown in FIG. 2, the size of the loop (19) has been adjusted by pulling the free end (17). The strap (5) has been adjusted to a length, such that fingers are retained within the strap (5) and the strap (5) is sized such that the strap (5) will be taut when the golfer's hand is closed onto the grip at a desired position along the length of the grip.

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

The invention claimed is:

1. An improved method of swinging a golf club, a golf club being one comprising a two ended shaft, one end being a head end, and the other end being a grip end, a grip end being one that comprises a hand-engaging grip having a proximal end and a distal end and is configured to receive a swing-direction-relative trialing hand proximate the proximal end and a swing-direction-relative leading hand proximate the distal end, the method comprising:

providing a golf club attachment comprising a shaft cuff, engaging the shaft cuff to a location on the club which is closer to the grip end of the club than the other end of the club, the location being one selected from a list comprising a location on the grip which is proximate a part of the shaft that does not comprise the grip and a location on the shaft that is immediately proximate the grip, but which does not comprise the grip, providing a strap to the cuff, arranging the strap such that the strap engages the cuff and loopingly extends therefrom, along the length of the club towards the grip end, and loopingly returns towards the cuff, defining a loop adapted to receive fingers therethrough, the loop being a single circuit of several sequential sections, a departing section beginning proximate the cuff and extending toward the grip end, to a terminal section proximate the grip end, and a return section beginning proximate the terminal section and extending toward and ending proximate the cuff, inserting at least one encircled finger of the leading hand through the loop, such that the departing section passes between the grip and the fingers of the leading hand, the terminal section surrounds the most distal face of the at least one encircled finger, and the return section passing along the outside of the at least one encircled finger, parallel to the departing section but separated from the departing section by the structure of the at least one encircled finger, both the departing and return section being in contact with the at least one encircled finger and outside thereof, not between the at least one finger and the grip, closing plural fingers around the grip, the plural fingers including the at least one encircled finger which has been inserted through the loop, and plural non-encircled fingers comprising at least all of the fingers of the trailing hand, such that the return section passes between an encircled finger and a non-encircled finger, to come into contact with the return section, such that is continues to the cuff between the non-encircled fingers and the grip, parallel-to and in-contact-with the departing section, tightening the loop proximate the cuff, such that the length of the loop is shortened to a tight perimeter approximately equal to the cumulative distance from the cuff to the most distal face of the at least one encircled finger, the distance to traverse the most distal face of the at least one encircled finger, the distance from the end of the most distal face of the at least one encircled finger to the most proximal face of the at least one encircled finger, the distance from the outermost edge of the most proximal face of the at least one encircled finger to the innermost edge of the most distal face of the non-encircled finger which is immediately proximal to the most proximal encircled finger, and the distance from the innermost edge of the most distal face of the non-encircled finger which is immediately proximal to the most proximal encircled finger to the cuff, initiating the performance of a golf swing while said at least one encircled and said plural fingers are closed around the grip and while the at least one encircled finger remains inserted through the loop, effecting retainment of the grip in the hands with the normal force of the fingers of the leading hand applied to the grip, and the normal force of the fingers of the trailing hand applied to the grip, and loosening the grip between the fingers of the leading hand during the swing, to decrease the normal force applied to the grip between the fingers of the leading hand, and to shift the amount of the retainment force lost between the fingers of the leading hand and the grip to the terminal section of the loop, such that the center of rotation of the club moves toward the trailing hand, decreasing the radial distance of the swing from the center of the club end, such that the retainment force of the club while loosening the grip remains applied to the most distal face of the at least one encircled finger, throughout the entire range of motion of the most distal finger of the at least one encircled finger.

2. The method of claim 1, wherein performance of the golf swing causes the strap to be pulled taut, and retains the fingers around the golf club grip with respect to the location with an amount of grip force that is less than the amount of grip force that would be required to perform the swing without the attachment.

3. The method of claim 1, and wherein the thumb, the palm, and the wrist of the leading hand are not inserted into the loop and no part of the leading hand below the fingers, is inserted into the loop.

4. The method of claim 1, wherein at least one encircled finger comprises the middle, ring, and pinky fingers and the index finger is a non-encircled finger, such that the most distal non-encircled finger is the index finger and the most distal face of the most distal non-encircled finger is the side of the index finger that faces the middle finger, the most proximal face of the most proximal encircled finger is the side of the middle finger that faces the index finger, and wherein the most distal face of the at least one encircled finger is the side of the pinky finger which faces away from the ring finger, and wherein a golf swing comprises performance of a backswing, such that during the backswing, the encircled fingers loosen from the grip while the decrease in retainment by grip force is maintained by the axial tension force in the loop, in the direction between the distal face of the pinky finger and the movement of the head of the club during the backswing, which does not change direction while the fingers loosen, and while the head end of the club decreases in radial distance from the torso at the end of the backswing.

5. The method of claim 1, wherein at least one encircled finger comprises the ring and pinky fingers and the index and middle fingers are non-encircled fingers, such that the most distal non-encircled finger is the middle finger and the most distal face of the most distal non-encircled finger is the side of the middle finger that faces the ring finger, the most proximal face of the most proximal encircled finger is the side of the ring finger that faces the middle finger, and wherein the most distal face of the at least one encircled finger is the side of the pinky finger which faces away from the ring finger, and wherein a golf swing comprises performance of a backswing, such that during the backswing, the encircled fingers loosen from the grip while the decrease in retainment by grip force is maintained by the axial tension force in the loop, in the direction between the distal face of the pinky finger and the movement of the head of the club during the backswing, which does not change direction while the fingers loosen, and while the head end of the club decreases in radial distance from the torso at the end of the backswing.

6. The method of claim 1, the strap comprising a free end proximate the cuff, wherein the loop is adjustable such that it is configured to be sized in order to provide tensile grip for a hand position that location to the end of the departing section of the loop at any position along the length of the grip between the location of the cuff and the end of the grip, by adjusting the strap by pulling the free end to increase the amount of the strap that is excluded from the loop.

7. The method of claim 1, and adjusting the loop to a length at which the strap retains the fingers of the leading hand such that the hand is held against sliding actually away from the cuff, independently of the force that the leading hand applies to the grip, such that the club cannot slip axially relative to the leading hand during the entire swing, irrespective of wrist position.

8. The method of claim 1, wherein the loop is in continuous tension throughout the entire golf swing.

9. The method of claim 1, wherein the golf swing is performed by a golfer having the leading hand, a torso and a trailing arm that comprises an elbow and the trailing hand, and wherein the leading hand comprises a wrist, and wherein performance of a golf swing comprises a backswing and a downswing, in which the downswing follows the backswing and comprises a point of release, a release being an articulation of the trailing hand relative to the leading hand effected by extension of the trailing arm as the elbow of the trailing arm approaches the torso during the downswing, and wherein the tension in the loop is carried in the fingers at a location offset from the wrist by at least the entire length of the palm and carried in a direction tangentially to the wrist of the leading hand such that, at the moment of the beginning of the release during the downswing, the wrist of the leading hand is a pure fulcrum relative to the tension in the loop, such that tension in the wrist is carried only in the plane of the swing, and is alleviated from providing grip force in the encircled fingers.

10. The method of claim 9, wherein the loop is in continuous tension throughout the entire swing, by tightening to a preload axial-tension force, and hold tight at the end of the backswing, and held tight under the tension in the club by the decreased radial distance of the clubhead from the torso through the downswing, and by tangential force of rotation during the release, and by inertia of the clubhead following the strike.

11. The method of claim 10, wherein the tension in the loop accelerates the head of the club at the moment of release without any increase in grip force at the encircled fingers.

12. The method of claim 1, wherein the increase in tension in the loop reduce his wrist tension without decreasing the total retainment force providing quality of the grip security of the leading hand and trailing hands on the grip.

13. The method of claim 9, wherein the end of the backswing is characterized by fixation of a lag angle between the forearm and upper arm of the trailing arm of the golfer by The decrease in radial distance of the clubhead at the end of the backswing, and which is maintained until the moment of release, the increase in tension in the loop facilitates loosening gripforce to alleviate tension in the wrist at the beginning of the downswing, such that the magnitude of the lag angle is increased and the length of the downswing before the release is increased.

* * * * *